US010194736B2

(12) United States Patent
Davis

(10) Patent No.: US 10,194,736 B2
(45) Date of Patent: Feb. 5, 2019

(54) RETRACTABLE BROOM

(71) Applicant: REACH OUT CONSULTING, LLC, Littleton, CO (US)

(72) Inventor: Michael Davis, Littleton, CO (US)

(73) Assignee: REACH OUT CONSULTING, LLC, Littleton, CO (US)

( * ) Notice: Subject to any disclaimer, the term of this patent is extended or adjusted under 35 U.S.C. 154(b) by 171 days.

(21) Appl. No.: 15/486,126

(22) Filed: Apr. 12, 2017

(65) Prior Publication Data

US 2017/0332772 A1 Nov. 23, 2017

Related U.S. Application Data

(60) Provisional application No. 62/337,792, filed on May 17, 2016.

(51) Int. Cl.
*A46B 5/00* (2006.01)
*A46B 17/04* (2006.01)

(52) U.S. Cl.
CPC ..... *A46B 5/005* (2013.01); *A46B 17/04* (2013.01); *A46B 2200/302* (2013.01)

(58) Field of Classification Search
CPC . A46B 15/005; A46B 2200/302; A46B 17/04; A46B 15/0095; A46B 2200/405; A46B 7/023; A47L 13/51; A63B 17/00
USPC ..... 15/144.4, 184
See application file for complete search history.

(56) References Cited

U.S. PATENT DOCUMENTS

| | | | | |
|---|---|---|---|---|
| 3,029,455 | A * | 4/1962 | Siculan | A47L 13/52 15/144.4 |
| 5,915,435 | A * | 6/1999 | Wilen | A46B 17/04 15/144.4 |
| 6,393,646 | B1 * | 5/2002 | Beers, Jr. | A46B 17/02 15/144.4 |
| 6,880,197 | B2 | 4/2005 | Katz et al. | |
| 7,331,077 | B1 | 2/2008 | Henry | |
| 7,707,683 | B2 * | 5/2010 | Nurudeen | A46B 7/023 15/159.1 |
| 7,765,633 | B2 * | 8/2010 | Zen | A46B 5/0095 15/169 |

FOREIGN PATENT DOCUMENTS

| | | |
|---|---|---|
| CN | 203153657 U | 8/2013 |
| WO | WO 1995/022276 A1 | 8/1995 |

* cited by examiner

*Primary Examiner* — Laura C Guidotti
(74) *Attorney, Agent, or Firm* — Baker & Hostetler LLP

(57) ABSTRACT

A retractable broom comprises a handle section and a broom head section. The handle section includes a retractable handle with one or more movable locking joints including locking mechanisms that are configured to connect and interlock the sections of the retractable handle together. An arm, including a stationary locking joint, having a locking mechanism, at one end of the arm connects and interlocks the retractable handle to the arm. The other end of the arm is fixedly attached to a brush head. The broom head section also comprises a retractable cover and third locking joint with a locking mechanism that connects and interlocks the retractable cover to the arm at two or more positions, with at least one position causing the retractable cover fully cover the brush head and a second position causing the retractable cover to at least partial uncover the brush head.

20 Claims, 9 Drawing Sheets

10

RETRACTABLE BROOM

CROSS REFERENCE TO RELATED APPLICATIONS

This application claims benefit under 35 U.S.C. § 119(e) of Provisional U.S. Patent Application No. 62/337,792, filed May 17, 2016, the contents of which is incorporated herein by reference in its entirety.

TECHNICAL FIELD

The disclosure generally relates to brooms, and more particularly to a portable, compact broom.

BACKGROUND

At sporting events, fans bring a wide variety of novelty items and signs to cheer for teams. In some sports (e.g., baseball), teams will play a series of successive games against another team. These events often draw out the most avid fans and creative displays in hopes that their team will "sweep" the series by winning all the games. One way for a fan to symbolize a "sweep" is to use the household item commonly associated with that of a broom. However, conventional brooms, with long, firm handles, are often impractical to bring to sporting events. The length can cause transportation difficulties in large crowds, and events may have strict size and security restrictions on items brought by fans.

Current broom and similar brush designs that address storage and portability issues include brooms with detachable heads and retractable handles (see, e.g., U.S. Pat. No. 6,880,197 B2 to Katz, et al., and U.S. Pat. No. 7,331,077 to Henry), or a detachable head which may be stored inside the handle (see, e.g., U.S. Pat. No. WO 1995/022276). While these designs somewhat improve portability, fans must keep track of several pieces, and spend time assembling the brooms. Brooms with retractable heads eliminate the assembly inconvenience issue, but current designs require the retractable heads to be symmetric and able to fold into the handle by means of a spring hinge and pull rod (U.S. Pat. No. CN203153657). The fixed-length handles on these designs limit portability and storage efficiency. The variety of brush head designs is also limited, since the size and shape must conform to the handle size and spring hinge orientation. Therefore, a need exists for a portable, compact broom which fans can efficiently store and transport without disassembly.

SUMMARY

This Summary is provided to introduce a selection of representative concepts in a simplified form that are further described below in the detailed description. This summary is not intended to identify key features or essential features of the claimed subject matter, nor is it intended to be used in any way that would limit the scope of the claimed subject matter.

According to a first aspect, there is provided a broom. The broom comprises a handle section and a broom head section. The handle section includes a retractable handle with one or more movable locking joints including locking mechanisms that are configured to connect and interlock the sections of the retractable handle together. An arm, including a stationary locking joint, having a locking mechanism, at one end of the arm connects and interlocks the retractable handle to the arm. The other end of the arm is fixedly attached to a brush head. The broom head section also comprises a retractable cover and third locking joint with a locking mechanism that connects and interlocks the retractable cover to the arm at two or more positions, with at least one position causing the retractable cover fully cover the brush head and a second position causing the retractable cover to at least partial uncover the brush head.

According to a second aspect, there is a broom comprising a retractable handle section and a broom head section. The handle section includes a retractable handle with one or more movable locking joints including locking mechanisms that are configured to connect and interlock the sections of the retractable handle together. An arm, including a stationary locking joint, having a locking mechanism, at one end of the arm connects and interlocks the retractable handle to the arm. The other end of the arm is fixedly attached to a brush head. The broom head section also comprises a retractable cover and third locking joint with a locking mechanism that connects and interlocks the retractable cover to the arm at two or more positions.

BRIEF DESCRIPTION OF THE DRAWINGS

The foregoing Summary and the following Detailed Description are better understood when read in conjunction with the appended drawings. In order to illustrate the present disclosure, various aspects of the disclosure are shown. However, the disclosure is not limited to the specific aspects discussed. The following figures are included.

DETAILED DESCRIPTION OF ILLUSTRATIVE EMBODIMENTS

A compact broom is disclosed that is convenient to transport, store, and/or use. The broom is configured such that the handle of the broom minimizes in length and keeps an attached brush head covered when not in use. The broom generally comprises a retractable handle, an arm, a broom head (including a retractable cover and a brush head), and at least one locking mechanism. The handle extends or retracts through several joints that become progressively smaller. The arm extends into the retractable cover and attaches to the brush head. The arm and retractable cover also move relative to one another so that the brush head may be surrounded by the retractable cover.

The compact broom disclosed herein is portable and can be efficiently stored and transported without disassembly and reassembly. This makes the broom particular well suited for transportation to sporting events, where it can be extended and used by fans. The broom can also be used as a real broom, thereby enabling fans to clean off their seats or the stadium concrete below their feet. As there is also often a need for a portable, compact broom for use in small spaces including apartments and small homes, boats, RV's, campers, tents, truck beds, trailers, etc. When traveling outside the home, people often have a need for a broom that can be made as compact as possible so as to minimize storage requirements. This requires a broom that is easy to pack and transport while remaining durable during use and travel. The cover for the broom also protects the bristles when not in use, which prevents the bristles from being bent out of shape while stored and allows for easy storage, cleanliness and longevity.

Figure 1A:
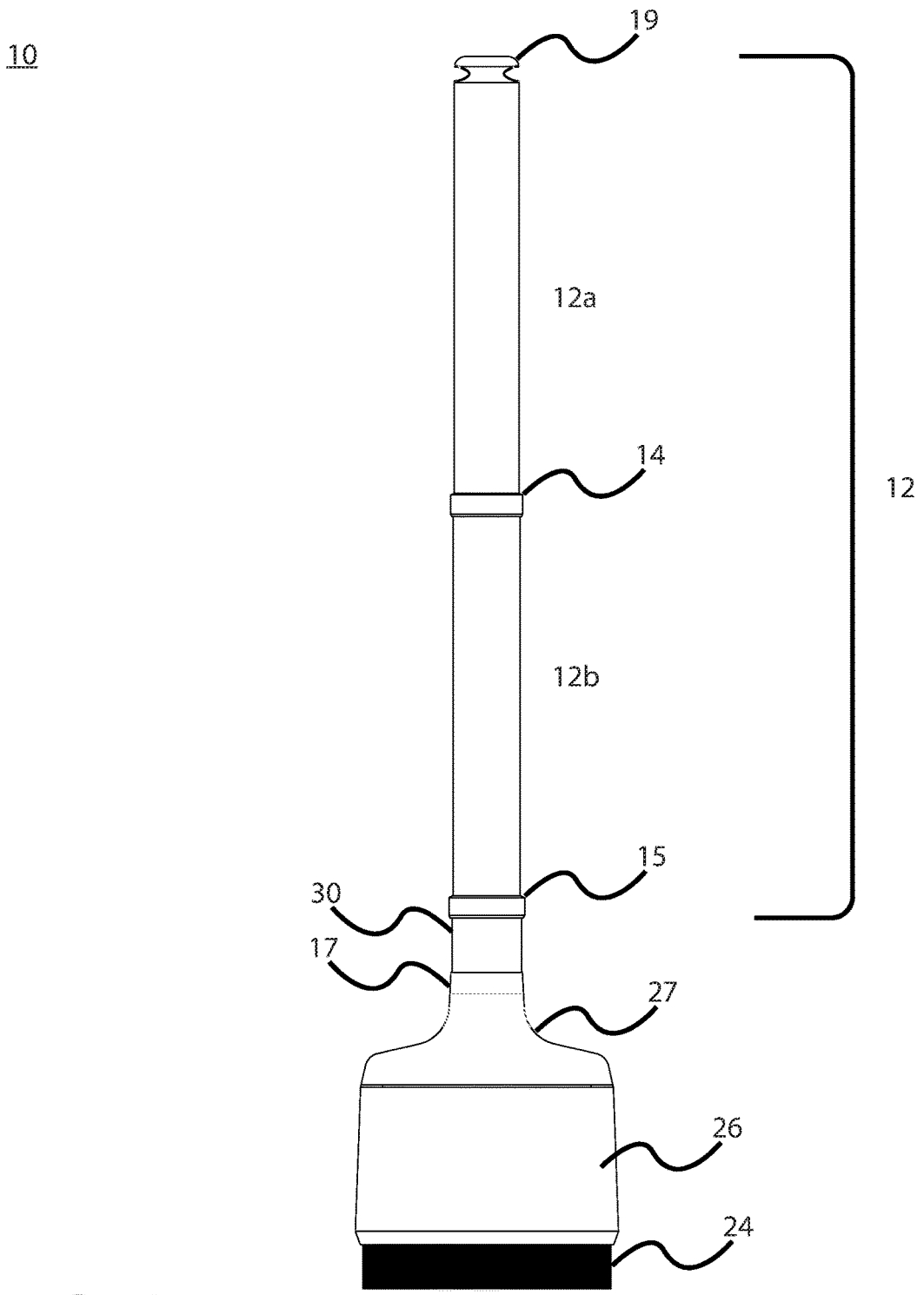
FIG. 1A illustrates a front view of a broom in an open/extended position.

Referring now to FIG. 1A, a perspective view of broom 10 is depicted. The broom 10, in one example embodiment, includes a handle section 12, which includes a movable locking joint 14. In alternate embodiments, handle section 12 includes more than one moveable locking joint 14, each moveable locking joint 14 being between different sections of handle section 12. As depicted, moveable locking joint 14 is configured to interlock, couple, or connect a first section 12*a* of handle section 12 and a second section 12*b* of handle section 12. An arm 30 includes a stationary locking joint 15, as shown in FIG. 1, located between the second section 12*b* of the handle section 12 and the arm 30. A third locking joint 17 joins the broom head section 27, to the arm 30. The broom head section 27 includes a retractable cover or cover section 26 and a brush head 24.

As described in further detail below, broom 10 in FIG. 1A is configured such that the handle section 12 is retractable, i.e., a retractable handle 12. In FIG. 1A, the moveable locking joint 14 is located in the middle portion of the retractable handle 12. The moveable locking joint 14 and stationary locking joint 15 is configured so that when pressure is applied to each of the moveable locking joint 14 and stationary locking joint 15 respectively, the retractable handle 12 retracts, collapses, or closes from an extended/open position to a closed/retracted position.

For example, when pressure is applied at moveable locking joint 14, a locking mechanism (not shown) within the moveable locking joint 14 releases and the first section 12*a* (e.g., the top half) of retractable handle 12 retracts into the second section 12*b* (e.g., the bottom half) of retractable handle 12. The process to retract the retractable handle 12 is similar to the operation of a telescoping telescopic. Once the first section 12*a* of the retractable handle 12 is retracted into a second section 12*b* of the retractable handle 12, pressure is applied to stationary locking joint 15. By applying pressure to stationary locking joint 15, the locking mechanism (not shown) within stationary locking joint 15 is released and the retractable handle 12 further retracts (also in a telescoping manner) into arm 30 via stationary locking joint 15. As a result, the moveable locking joint 14 slides or moves down towards the stationary joint 15. This complete retraction of retractable handle 12 into the arm 30 is further depicted and described in FIG. 1C.

Although pressure is described as being applied to the moveable locking joint 14 prior to applying pressure to the stationary locking joint 15, it is possible to apply pressure to the stationary locking joint 15 first before applying pressure to moveable locking joint 14. In other words, in alternate embodiments, pressure is applied to either of the locking joints, regardless of the order, to retract retractable handle 12.

The pressure applied to moveable locking joint 14 and/or stationary locking joint 15 to cause the retractable handle 12 to retract is accomplished by a user applying force to the respective locking joints. For example, a user applies a squeeze, pinch, or twisting pressure at the respective locking joints. However, as is known to those skilled in the art, the above mentioned types of pressure are merely non-limiting examples. Other types of forces or pressure may be applied at the locking joints to close or retract the retractable handle 12.

Further referring to FIG. 1A, as noted, the moveable locking joint 14 and the stationary locking joint 15 each includes a locking mechanism of a known type. For example, each of the locking mechanisms includes a fastener that interlocks or connects the respective handle sections of the retractable handle 12, and which allows one handle section to move relative to the other handle section when the locking joint's is turned in one direction so as to deactivate the locking joint's locking mechanism, and prevents movement of the handle sections relative to one another when the locking joint is turned in an opposite direction to activate the locking mechanism, such as by tightening a band inside the locking mechanism joint around the perimeter of the handle section. Other locking known mechanisms, including a snap-lock fastener, a pin fastener, or another type of twist-lock fastener may likewise be utilized. The locking mechanism of moveable locking joint 14 may be configured to interlock or connect separate handle sections 12*a* to 12*b* of the retractable handle 12, while the locking mechanism of stationary locking joint 15 may be configured to interlock or connect handle section 12*b* to one end of the arm 30.

The other end of arm 30 is fixedly attached to the brush head 24, for example, as shown with respect to how brush head 34 is attached to arm 40 of FIG. 2A, further described below. A third locking mechanism within locking joint 17 is connected to cover section 26 and is configured to interlock or connect the cover section 26 to two or more positions along a length of arm 30. When the locking mechanisms of all three locking joints are released, the broom 10 may be retracted from its open/extended position to a closed/retracted position, and vice versa. Once the broom 10 has been put into the closed/retracted position, the locking mechanisms of the locking joints may be tightened to prevent the broom from unintendedly moving to the open/extended position.

FIG. 1A also illustrates a knob 19 located on or attached to the top of the retractable handle 12. Knob 19 will be described in more detail with respect to FIG. 1B below.

Figure 1B:
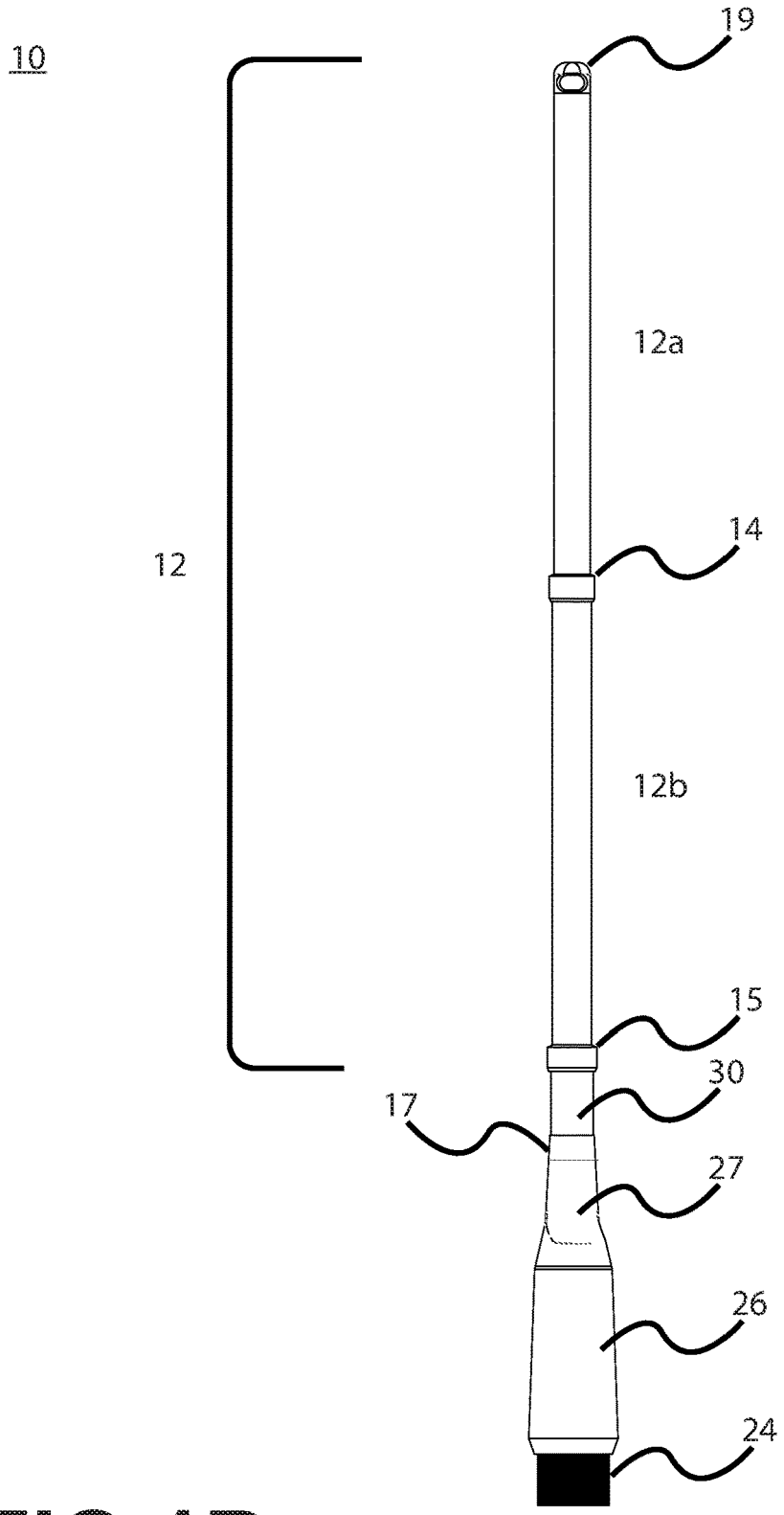
FIG. 1B illustrates a side view of the broom in the open/extended position.

Referring to FIG. 1B, a side view of broom 10 is illustrated. Broom 10 is shown in FIG. 1B in its open/extended position. Similar to FIG. 1A, the stationary locking joint 15 of the retractable handle 12 continues to be located toward the bottom portion of the retractable handle 12. The moveable locking joint 14 also continues to be configured and located toward the middle portion on retractable handle 12. Both the moveable locking joint 14 and stationary locking joint 15 are configured with locking mechanisms as described above. Similar to the above description in regards to FIG. 1A, the locking mechanisms are configured to be released or unlocked when a user applies pressure or force. Moreover, a third locking mechanism interlocks or connects the retractable cover 26 of the broom head section 27 at one or more positions along the length of arm 30 and is configured to be released or unlocked such that the retractable cover 26 may slide along or move with respect to the arm 30. The retractable cover 26 interlocks or connects, through operation of the locking joint 17, to one or more additional positions along the arm 30. For example, the locking joint 17 interlocks or connects to a first position on the arm 30 such that the retractable cover 26 covers the entire brush head 24. In other words, when retractable cover 26 is released from the connection with the first position on arm 30 and slides along the arm 30 to connect to a second position on arm 30, for example, the retractable cover 26 moves from completely covering brush head 24 to completely uncovering brush head 24 or only partially covering brush head 24, depending on the location of the second position on the arm 30.

In FIG. 1B, a knob 19 on top of the retractable handle 12 is illustrated. The knob 19 is configured to include an opening such that broom 10 can be latched onto a hook (not depicted here in FIG. 1B) for storage purposes or clipped to a carabiner or other type of clamp that is in turn attached to a belt or belt loop of a person or to a pack so the broom 10 can be carried hands free. The knob 19 may be attached or affixed to the top portion of the retractable handle 12 in various ways. As one example, the knob 19 may be affixed onto the top portion of the retractable handle 12 during the manufacturing process. As is known to those skilled in the art, knob 19 of FIG. 1B is one non-limiting example. Other types or configurations of knob 19 may be manufactured or added onto broom 10 in an effort to conveniently store the broom 10.

FIG. 1B further illustrates that retractable cover 26 only partially covering brush head 24. This serves to illustrate that the position of the retractable cover 26 relative to the broom head 24 is independent of the position of the handle sections 12*a* and 12*b* to one another or retractable handle 12 relative to arm 30. For example, handle section 12*a* could be retracted and largely positioned within the interior of handle section 12*b*, which is in turn retracted and largely positioned within the interior of arm 30, while the retractable cover 26 is positioned to either fully cover the brush head 24, only partially cover the brush head 24, or completely uncover the brush head 24. Likewise, the retractable handle 12 could be fully extended or open while the retractable cover 26 partially covers or fully covers the brush head 24.

Figure 1C:
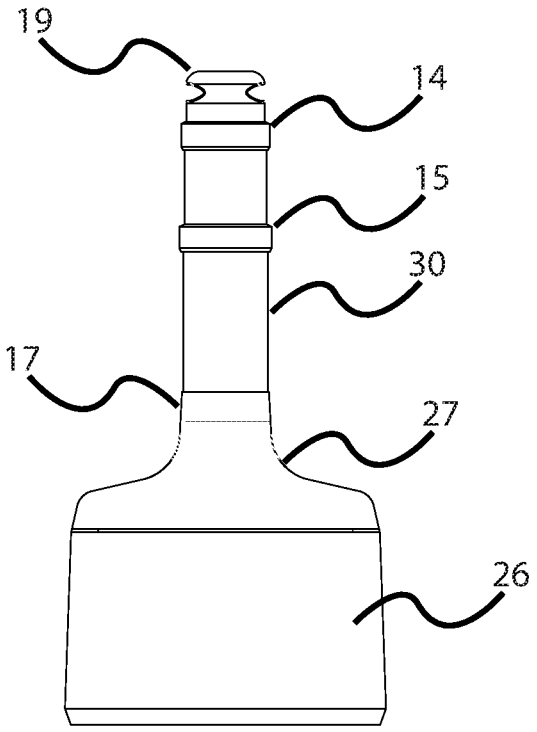
FIG. 1C illustrates a front view of the broom of FIGS. 1A and 1B in a closed/retracted position.

FIG. 1C illustrates broom 10 in the fully retracted or stowed position. In other words, FIG. 1C illustrates broom 10 in the fully closed/retracted position. The closed/retracted position is configured so that the retractable handle 12 is retracted into arm 30 via stationary locking joint 15. Put simply, FIG. 1C illustrates that broom 10 is retracted to a length that makes it easy to transport and store. As described above, the retractable handle 12 is configured to retract in a telescoping manner, with the smaller diameter section, i.e., handle section 12*a*, of the retractable handle 12 fitting within the length of the larger diameter section, i.e., handle section 12*b*, and with handle section 12*b* then largely fitting within arm 30. When moveable locking joint 14 is pressured or receives some sort of force, the locking mechanism therein is released and a first handle section 12*a* of the retractable handle 12 retracts into the second handle section 12*b* of the retractable handle 12. Similarly, when stationary locking joint 15 is pressured or receives some force, the locking mechanism therein is released and the entire retractable handle 12 retracts into arm 30 via stationary locking joint 15.

Further referring to FIG. 1C, when broom 10 is in the closed/retracted position, retractable cover 26 can be configured to substantially all of brush head 24. This is achieved by releasing or unlocking the third locking mechanism by applying pressure or force to the locking joint 17 that connects the retractable cover 26 to the arm 30. When the third locking mechanism is released, the retractable cover 26 slides along the arm 30 and connects to another position along the arm 30 such that the retractable cover 26 covers substantially all of brush head 24.

Figure 2A:
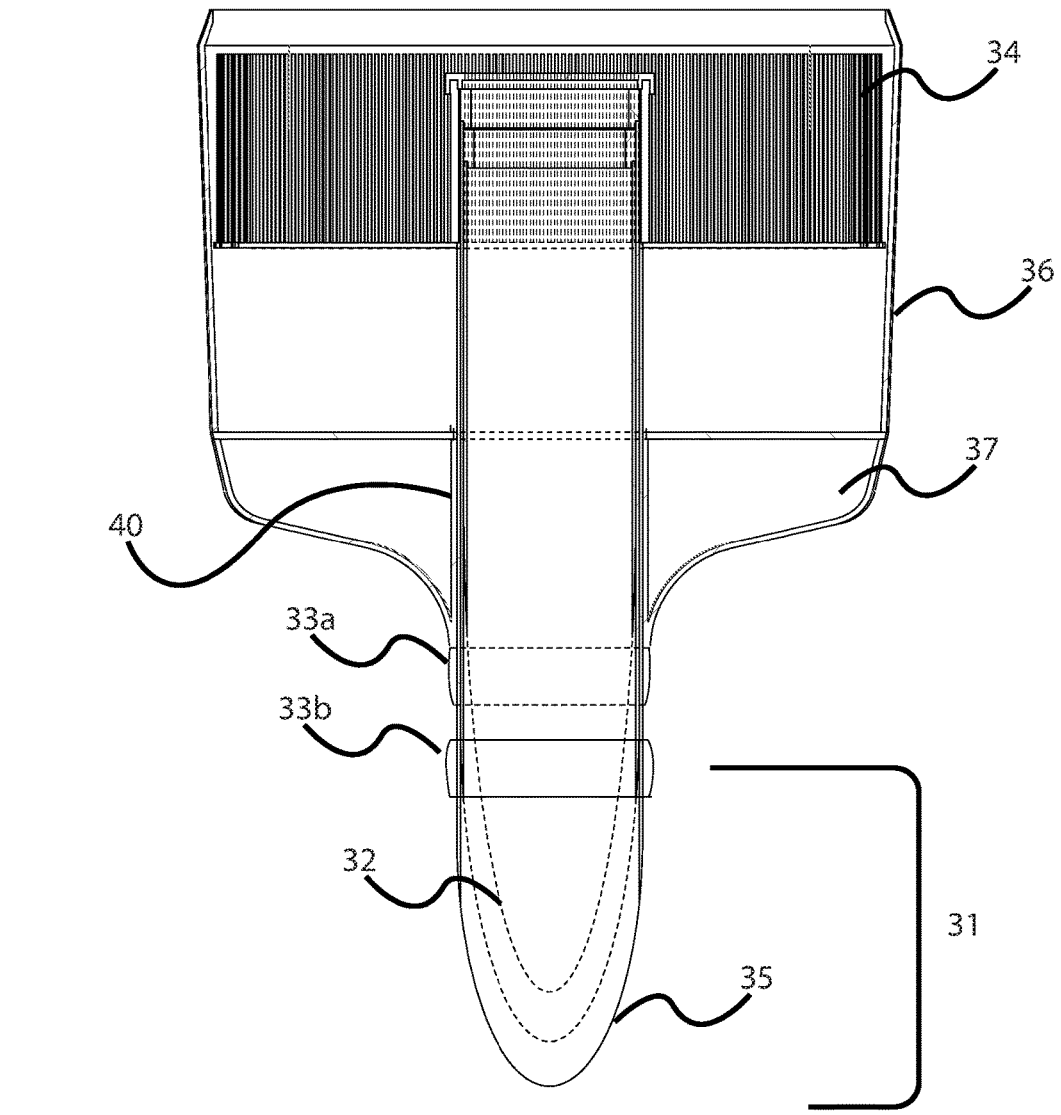
FIG. 2A illustrates a partial cross-sectional, front plan view of an alternate broom embodiment of FIG. 1C in a closed/retracted position.

Referring now to FIG. 2A, an alternate embodiment, broom 20, is depicted. Broom 20 is shown in its closed or retracted position. Broom 20 of FIG. 2A includes a handle section 31 that includes both moveable and stationary handles instead of moveable joints as depicted in FIGS. 1A-1C. A stationary handle 35 is shown in FIG. 2A by solid lines, while other moveable handles 32 (as shown in dashed lines) are stored within stationary handle 35. The broom 20 further includes at least one or more locking joints 33*a*-33*b*, a broom head 37 attached to an arm 40, and a retractable cover or cover section 36 configured to cover a brush head 34.

The broom 20 in FIG. 2A includes a handle section or retractable handle section 31 where separate moveable handles 32 of the retractable handle 31 retract into or inside of a stationary handle 35. A locking joint 33*b*, having an internal locking mechanism the same as or similar to those described above, connects the retractable handle 31 with the arm 40. Locking joint 33*b* as illustrated in FIG. 2A may be configured such that when a user applies force or pressure to joint 33*b* the moveable handles 32 collapse and retracts into stationary handle 35. The collapse or retraction of moveable handles 32 may be performed in a telescopic manner similar to that described above. In other words, the moveable handles 32 may slide within each other and be positioned inside of stationary handle 35 for ease of storage and transportation. In an alternate embodiment, a user may push or press down on the stationary handle 35 to collapse or retract the moveable handles 32 without applying pressure to locking joint 33*b*. Thus, in the alternate embodiment, pressure may be applied to the stationary handle 35 to collapse the broom without having to apply any pressure to joint 33*b* to release locking mechanism. Alternatively, the moveable handles 32 may be configured to lock and unlock relative to one another by turning one moveable handle relative to another movable handle, which would cause a locking mechanism positioned between the handle sections to engage and disengage.

Locking joint 33*a*, located between the arm 40 and broom head section 37, is configured to interlock or connect the arm 40 and the broom head section 37. In FIG. 2A, the retractable cover 36 covers substantially all of brush head 34 while the broom 20 is in its closed or retracted position. However, in alternate embodiments, the retractable cover 36 may open and only partially cover the brush head 34. A user may apply force or pressure (e.g., squeeze, pinch, or twist) to locking joint 33*a* so that the retractable cover 36 slides away from its closed position and opens the retractable cover 36 to reveal part of the brush head 34. Once opened, the locking joint 33*a* may be configured to interlock or connect with a position along the arm 40 that is near or adjacent to locking joint 33*b*.

Figure 2B:
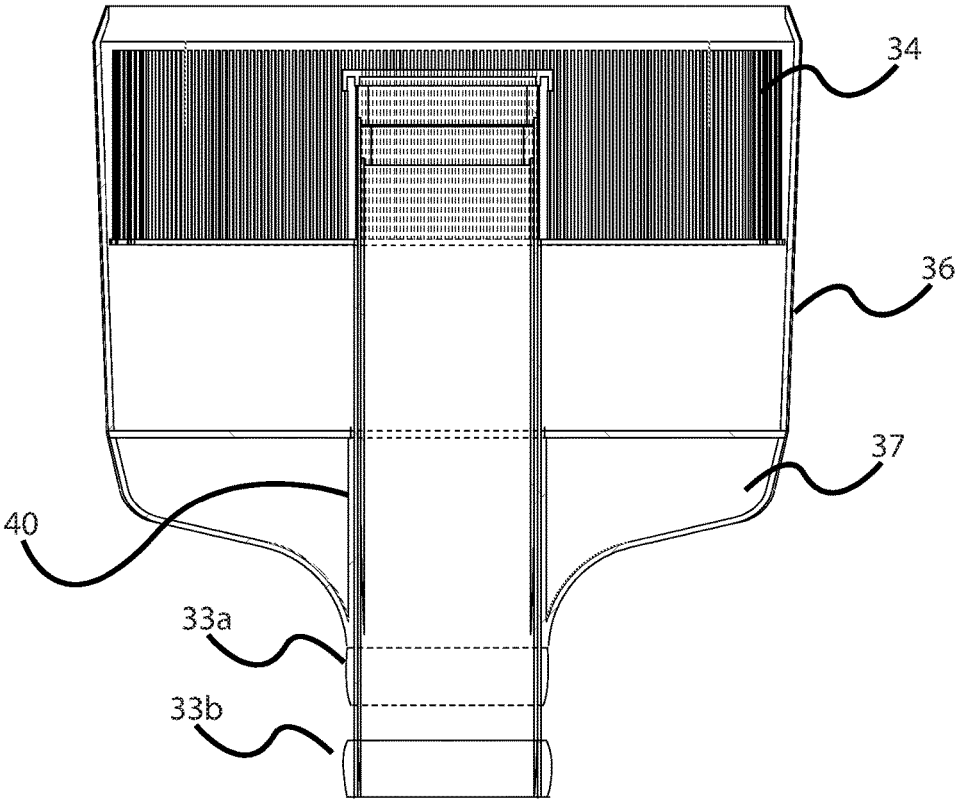
FIG. 2B illustrates a partial cross-sectional, front plan view of an alternate broom embodiment of FIG. 1C in the closed/retracted position.

FIG. 2B illustrates an alternate embodiment of broom 20 where the entire handle section 31 (shown in FIG. 2A) is retracted into arm 40. In other words, the moveable handles 32 (shown in FIG. 2A) have been retracted into stationary handle 35 (shown in FIG. 2A) and the stationary handle 35 is further retracted into or inside of the arm 40. The handle section 31, similar to the previously described manner of retracting, is entirely retracted into arm 40 via a telescoping manner. In this manner, broom 20 is configured to be even shorter in length for users to transport and store. In yet another embodiment, the arm 40 may also be retractable and configured to retract entirely inside of broom cover 36. This may provide for more convenient storage possibilities. In FIG. 2B, broom 20 continues to include a retractable cover 36 that is configured to cover partially or substantially all of the brush head 34.

Figure 3:
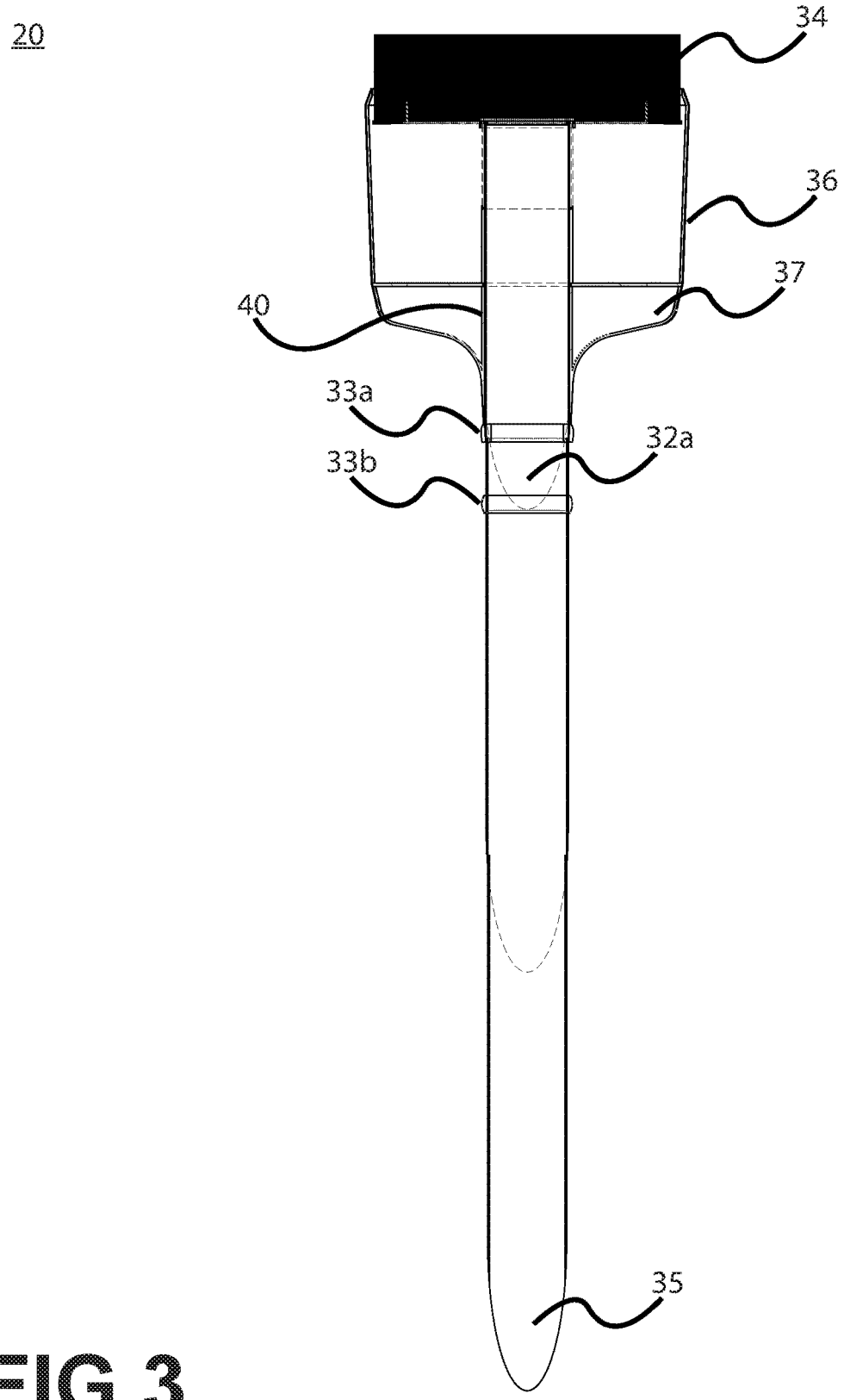
FIG. 3 illustrates partial cross-sectional, front plan view an alternate perspective view of the broom in an open/extended position.

FIG. 3 illustrates the broom 20 of FIG. 2A in its open or extended position. The stationary handle 35 of the retractable handle section 31 has released a number of additional movable handles 32 from their stored position within stationary handle 35. In particular, moveable handles 32*a* and 32*b* as shown in FIG. 3 are in the extended or open position. Moreover, FIG. 3 illustrates that the retractable cover 36 has released the brush head 34 from the cover 36 so that less than substantially all of the brush head 34 is surrounded by the cover 36. As described above in reference to FIG. 2A, the retractable cover 36 may be released from one position on the arm 40 to another position on the arm 40 so that the retractable cover 36 either uncovers and reveals part of the brush head 34 or entirely covers all of the brush head 34.

Figure 4:
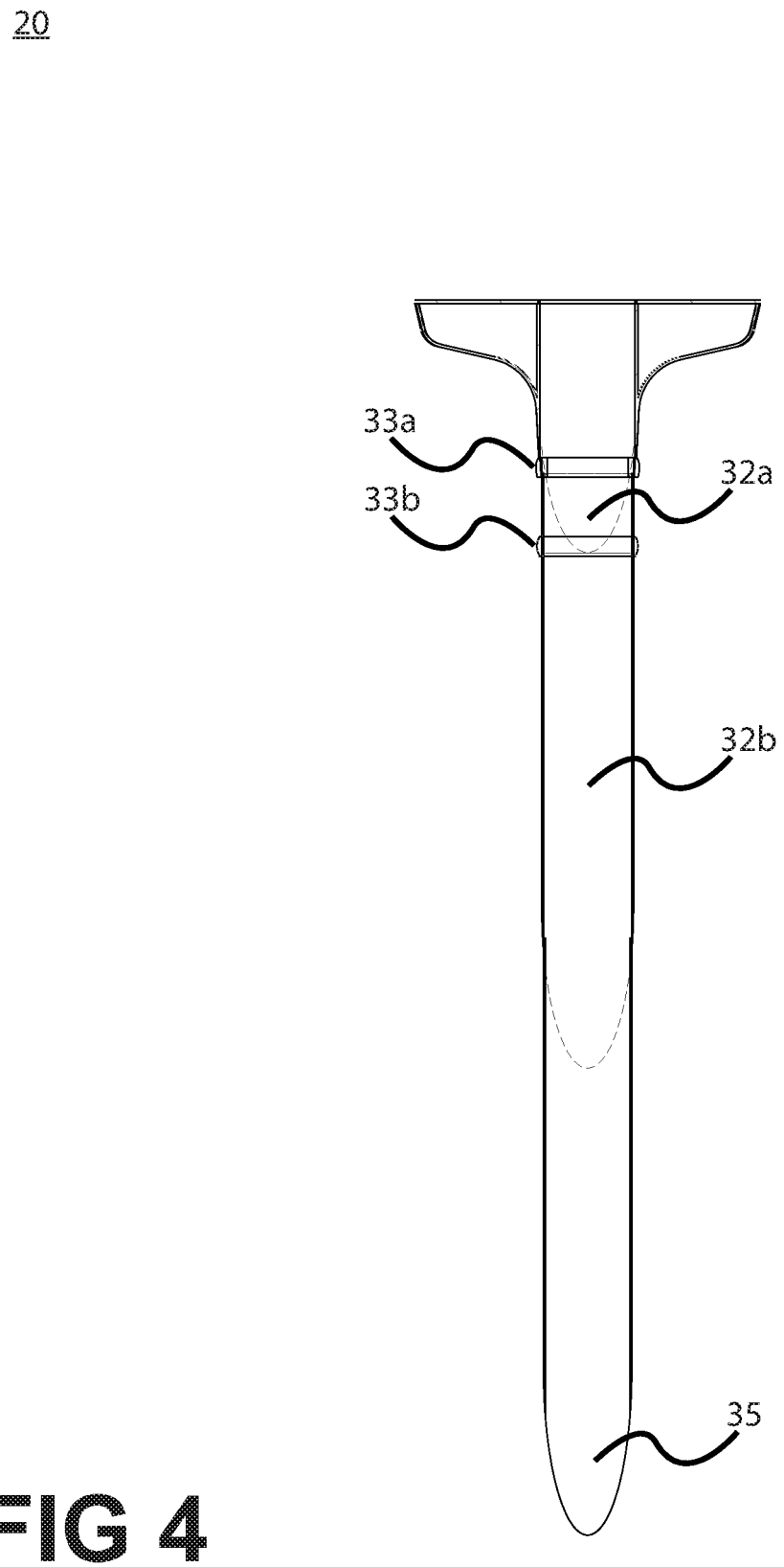
FIG. 4 illustrates a side plan view of the broom of FIG. 3 in the open/extended position, without the broom head.

FIG. 4 illustrates a side view of broom 20 in FIG. 3 without the retractable cover 36 or brush head 34. Broom 20 of FIG. 4 depicts the stationary handle 35, with one or more movable handles 32*a*-32*b* extended away from the stationary handle 35. The locking joint 33*b* may be positioned between the arm 40 and the movable handle 32*a*.

Moreover, FIG. 4 further illustrates locking mechanism 33*a* that is located on arm 40 and configured to interlock or connect the arm 40 with the broom head 37 (shown in FIG. 2A). Locking mechanism 33*a* is internally connected to locking joint 33*b* such that when locking joint 33*b* is turned in one direction to a certain extent, locking mechanism 33*a* retracts into arm 40 and when locking joint 33*b* is turned in an opposite direction to a certain extent, locking mechanism 33*a* extends from arm 40.

Figure 5:
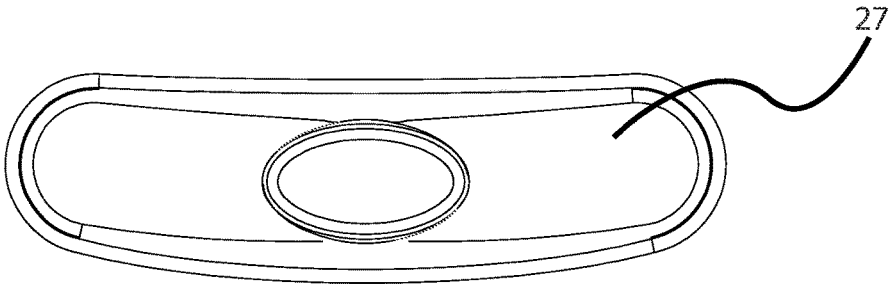
FIG. 5 illustrates a top view of the broom head.

FIG. 5 illustrates a top view of broom head 27 of FIGS. 1A-1C. As described above in FIGS. 1A-1C, the broom head 27 is configured to interlock or connect to the arm via a locking mechanism (not depicted here in FIG. 5). In an example embodiment, the arm is circular and may be configured to fit into a circular opening of the broom head 27. As is known to others skilled in the art, the shape of a circle is a non-limiting example. The shape of the arm and the broom head 27 may be of any shape or form. The arm and the broom head 27 may be interlocked or connected via a fastener or some type of fastening process. The fastener may be a locking mechanism similar to that of a snap-lock. However, other types or forms of locking mechanisms may be used to connect the arm and the broom head 27.

Figure 6:
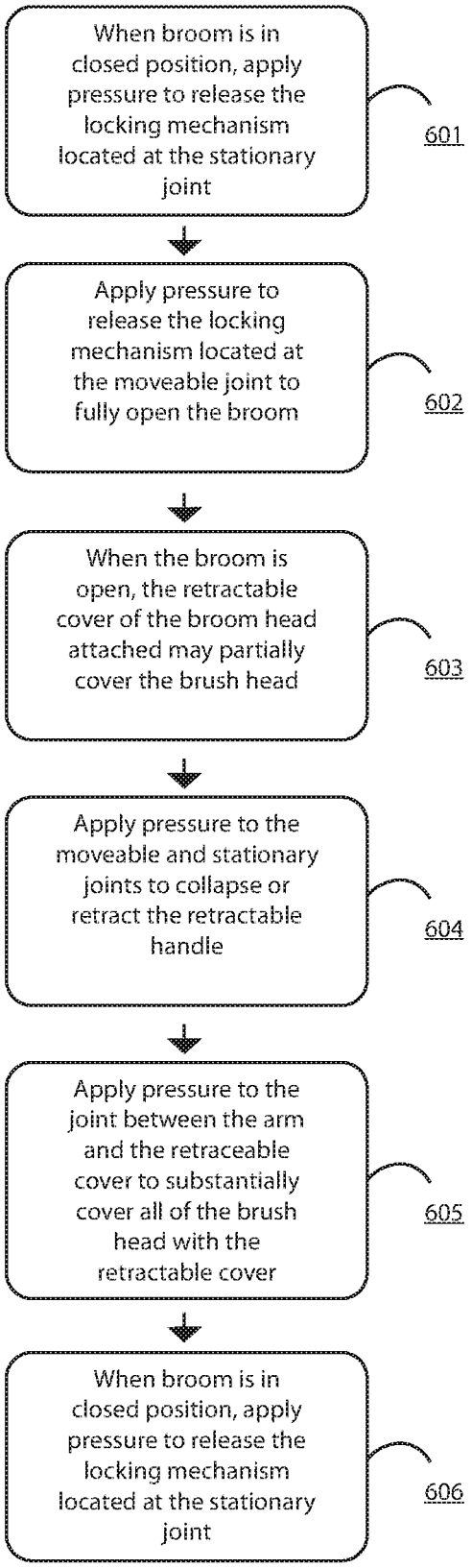
FIG. 6 illustrates a flowchart depicting the method or process of opening the broom from a closed/retracted position to an open/extended position and retracting the broom from an open/extended position to a closed/retracted position.

FIG. 6 illustrates the method or process of opening the broom from a closed/retracted position to an open/extended position and further illustrates retracting the broom from an open/extended position to a closed/retracted position. Block 601 depicts that the broom when in the closed or retracted position is configured to open by releasing a locking mechanism located at the stationary joint that connects the retractable handle to the arm. The retractable handle may be released when a user presses, twists, squeezes, or pinches on the stationary joint. When the stationary joint receives sufficient force or pressure, the locking mechanism at the stationary joint allows the one or more retractable handles to be released and extended away from the stationary joint.

In block 602, upon release of the locking mechanism at the stationary joint, the retractable handle is pulled away from the stationary joint. Once the retractable handle is pulled away, the locking mechanism at the stationary joint may re-interlock and re-connect with the retractable handle to prevent movement between the retractable handle and the arm when the broom is in the open/extended position.

Furthermore, block 602 depicts that in order to fully expand and open the retractable handle, a pressure or force may also be applied to locking mechanism located at the moveable joint. By releasing the locking mechanism at the moveable joint, the first section of the retractable handle is pulled away from the second section of the retractable handle. Once the first section is pulled away, the locking mechanism at the moveable joint may re-interlock and re-connect to prevent movement between the first section of the retractable handle and the second section of the retractable handle. The broom now may be in the full open/expanded configuration when the entire retractable handle is extended or elongated.

Moreover, in block 603, the broom, in its expanded configuration, may be ready to wave in the air during a sporting event (e.g., baseball game). In another embodiment, the broom, in its expanded configuration, may be utilized to sweep dust or dirt on a floor surface. Put another way, the broom may also be configured for cleaning purposes. The broom may be equipped with a broom head that includes a retractable cover and a brush head. When the retractable cover only partially covers the brush head, the broom is in configuration to be waved or used to sweep the ground. In an alternate embodiment, when the broom is in the open or extended position, the retractable cover of the broom head may also be configured to cover the brush head in its entirety. In this configuration, the broom may still be used to wave around in the air, but may not be used to sweep dirt off the floor.

Block 604 describes first applying pressure to the moveable joint in an effort collapse the first section of the retractable handle into the second section of the retractable handle. The pressure applied to the moveable joint may be that of a user squeezing, pinching, and/or twisting the locking mechanism located at the movable joint. Moreover, a user may then apply pressure to the stationary joint of the broom that connects the arm and the retractable handle. By applying pressure to the stationary joint in either the form of the above mentioned pressures via a user's hands or via some other source of pressure, the locking mechanism at the stationary joint may be released and thereby causing the retractable handle to collapse or retract fully into the arm via the stationary joint.

Block 605 further depicts that pressure may also be applied to the locking mechanism located at the joint between the retractable cover and the arm. The retractable cover may be interlocked or connected to the arm at a first position of the arm. In its first position, the retractable cover may not completely cover the brush head. However, if pressure is applied to the locking mechanism the retractable cover may be released from its first position on the arm and move along or slide down the arm to a second position on the arm. In this second position, the retractable cover may completely or substantially cover all of the brush head. This closed or collapsed configuration allows a user to store or transport a broom in a more convenient manner. The retractable cover may also be configured to be locked at a third position on the arm (e.g., a position between the first and second positions) such that the retractable cover does not completely cover the brush head.

Block 606 depicts that the broom is in the closed, fully stowed, or collapsed position. Once in its collapsed configuration, the broom may continue to be transported to sporting events or even waved during a sporting event. A piece of strap, a separate handle, or a knob may be configured to attach or affixed to the broom so that it may be conveniently transported and/or stored for future use. Even further, once the broom is collapsed, the broom may fit into a separate carrying bag for transporting purposes. By returning to block 601, the method or process to open or expand the broom may be repeated.

Directional terms such as "top," "bottom," "upwards," "downwards," "vertically," and "laterally," are used in the following description for the purpose of providing relative reference only, and are not intended to suggest any limitations on how any article is to be positioned during use, or to be mounted in an assembly or relative to an environment. Additionally, the term "substantially" as used in this description is intended to describe a particular characteristic of a claimed element. Further, the term "couple" and variants of it such as "coupled", "couples", and "coupling" as used in this description are intended to include indirect and direct connections unless otherwise indicated. For example, if a first handle section is coupled to a second handle section, that coupling may be through a direct connection or an affixation.

The various features and processes described above may be used independently of one another, or may be combined in various ways. All possible combinations and sub-combinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed example embodiments. The example systems and components described herein may be configured differently than described. For example, elements may be added to, removed from, or rearranged compared to the disclosed example embodiments.

While this document contains many specifics, these should not be construed as limitations on the scope of an invention or of what may be claimed, but rather as descriptions of features specific to particular embodiments of the invention. Certain features that are described in this document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be exercised from the combination, and the claimed combination may be directed to a subcombination or a variation of a subcombination.

What is claimed is:

1. A broom, comprising:

a retractable handle including a first section, a second section, and a movable locking joint configured to telescopically join the first section to the second section;

an arm including a stationary locking joint located at a first end of the arm and configured to telescopically join the second section of the retractable handle to the arm, the arm having a second end configured to be fixedly joined to a brush head; and a retractable cover and a third locking joint joined to the retractable cover, the third locking joint being configured to position and hold the retractable cover at two or more positions along a length of the arm.

2. The broom of claim 1, wherein each of the moveable joint, the stationary locking joint, and the third locking joint includes a locking mechanism that is a fastener.

3. The broom of claim 2, wherein the fastener is at least one of: a snap-lock fastener, pin fastener, and a twist-lock fastener.

4. The broom of claim 2, wherein when pressure is applied, the fastener of the moveable locking joint is configured to release, unlock, or disconnect the first section of the retractable handle with the second section of the retractable handle.

5. The broom of claim 2, wherein when pressure is applied, the fastener of the stationary locking joint is configured to release, unlock, or disconnect the second section of the retractable handle and the arm.

6. The broom of claim 2, wherein when pressure is applied, the fastener of the third locking joint is configured to release, unlock, or disconnect the retractable cover from the first position along the length of the arm such that the retractable cover is configured to slide along the length of the arm and connect to a second position of the arm.

7. The broom of claim 1, wherein the brush head is at least partially uncovered when the retractable cover is positioned at a first position among the two or more positions by the third locking joint.

8. The broom of claim 1, wherein the retractable handle is configured to retract into the arm through the stationary locking joint, and wherein the arm, including the first and second sections of the retractable handle, is further configured to retract into the broom head.

9. The broom of claim 8, wherein the arm retracts into the broom head telescopically.

10. The broom of claim 1, wherein a knob is located near the top portion of the first section of the retractable handle, wherein the knob includes an opening configured to latch onto a hook.

11. A broom, comprising:

a retractable handle including a first section, a second section, and a movable locking joint configured to telescopically join the first section to the second section;

an arm including a stationary locking joint located at a first end of the arm and configured to telescopically join the second section of the retractable handle to the arm, the arm having a second end configured to be fixedly joined to a brush head; and a retractable cover and a third locking joint joined to the retractable cover, the third locking joint being configured to position and hold the retractable cover at two or more positions along a length of the arm, wherein the brush head is at least partially uncovered when the retractable cover is positioned at a first position among the two or more positions by the third locking joint, and wherein the brush head is fully covered when the retractable cover is positioned at a second position among the two or more positions by the third locking joint.

12. The broom of claim 11, wherein the first section of the retractable handle is configured to extend away from the moveable locking joint and the second section of the retractable handle is configured to extend away from the stationary locking joint when the broom is in an open position.

13. The broom of claim 11, wherein the first section of the retractable handle is configured to telescopically retract towards the moveable locking joint and second section of the retractable handle is configured to retract towards the stationary locking joint when the broom is in a closed position.

14. The broom of claim 11, wherein the retractable handle is configured to telescopically retract into the arm through the stationary locking joint, and wherein the arm, including the first and second sections of the retractable handle, is further configured to telescopically retract into the broom head.

15. The broom of claim 11, wherein the retractable cover, when connected to the first position along the length of the arm by the third locking joint, covers no part of the brush head, and the retractable cover, when connected to the second position along the length of the arm by the third locking joint, covers the entire broom head.

16. The broom of claim 11, wherein each of the moveable locking joint, the stationary locking joint, and the third locking joint includes a locking mechanism.

17. The broom of claim 16, wherein when pressure is applied, the locking mechanism of the moveable locking joint is configured to release, unlock, or disconnect the first section of the retractable handle with the second section of the retractable handle and the locking mechanism of the stationary locking joint is configured to release, unlock, or disconnect the second section of the retractable handle and the arm.

18. The broom of claim 17, wherein pressure is applied to the locking mechanisms of the moveable locking joint and the stationary locking joint from a user applying at least one of: squeezing, pinching, and twisting pressure.

19. The broom of claim 16, wherein when pressure is applied, the locking mechanism of the third locking joint is configured to release, unlock, or disconnect the retractable cover from the first position along the length of the arm such that the retractable cover is configured to slide along the length of the arm and connect to a second position of the arm.

20. The broom of claim 19, wherein pressure is applied to the locking mechanism of the third locking joint joined with the retractable cover from a user applying at least one of: squeezing, pinching, and twisting pressure.

* * * * *